US006299100B1

(12) United States Patent
Cloud

(10) Patent No.: US 6,299,100 B1
(45) Date of Patent: Oct. 9, 2001

(54) CABLE REEL LIFTER/TRANSPORTER

(76) Inventor: Ken Cloud, 1210 N. Jefferson St., Unit L, Anaheim, CA (US) 92807

( * ) Notice: Subject to any disclaimer, the term of this patent is extended or adjusted under 35 U.S.C. 154(b) by 0 days.

(21) Appl. No.: 09/221,484

(22) Filed: Dec. 28, 1998

(51) Int. Cl.[7] ..... B65H 16/06; B65H 54/553

(52) U.S. Cl. ..... 242/598.5; 242/129.6; 242/391.1

(58) Field of Search ..... 242/391.1, 391, 242/129.5, 598.5, 129.6

(56) References Cited

U.S. PATENT DOCUMENTS

| | | | | |
|---|---|---|---|---|
| 366,909 | * | 7/1887 | Wirt | 242/391 |
| 2,441,437 | * | 5/1948 | Morrone . | |
| 2,610,003 | * | 9/1952 | Bond et al. . | |
| 3,680,807 | * | 8/1972 | Fortson | 242/391 |
| 3,820,733 | * | 6/1974 | Roederer | 242/391 |
| 4,469,289 | * | 9/1984 | Gebo | 242/592 |
| 4,746,078 | * | 5/1988 | Setzke | 242/559.1 |
| 5,775,621 | * | 7/1998 | Sauber | 242/391.1 |

FOREIGN PATENT DOCUMENTS

494914 * 11/1938 (GB) .

* cited by examiner

*Primary Examiner*—Michael R. Mansen
(74) *Attorney, Agent, or Firm*—William L. Chapin

(57) ABSTRACT

A cable reel lifter/transporter apparatus for elevating a heavy cable reel above a surface to permit free rotation of the reel, thereby allowing cable or tubing to be payed off the reel, and for manually transporting cable reels includes a pair of L-shaped planar frames each having a long straight handlebar arm and a relatively short straight leg which depends perpendicularly downwards from a lower surface of the handlebar, near a front transverse end thereof, each leg having at the lower end thereof a short tubular foot. A tubular bearing support protruding upwards from each handlebar rotatably supports opposite ends of a horizontal cable reel support shaft. A pair of arbors slidable on the shaft have inner tapered portions insertable into a separate spindle hole in each of two disk-shaped end plates of a cable reel, and subsequently secured to the shaft to hold the shaft and cable reel in a fixed position between the frames. Hand pressure exerted downwardly on the rear ends of the handlebars pivots the legs around the tubular axes of the feet, causing the cable reel support shaft and cable reel to elevate the reel end plates to a freely rotatable position above the ground. Rotating the handlebars on the cable reel support shaft in an opposite direction elevates the legs and feet above the ground, allowing the rear ends of the handlebars to be grasped to push the reel rollably along a surface, the cable reel end plates serving as wheels.

22 Claims, 12 Drawing Sheets

Fig-1
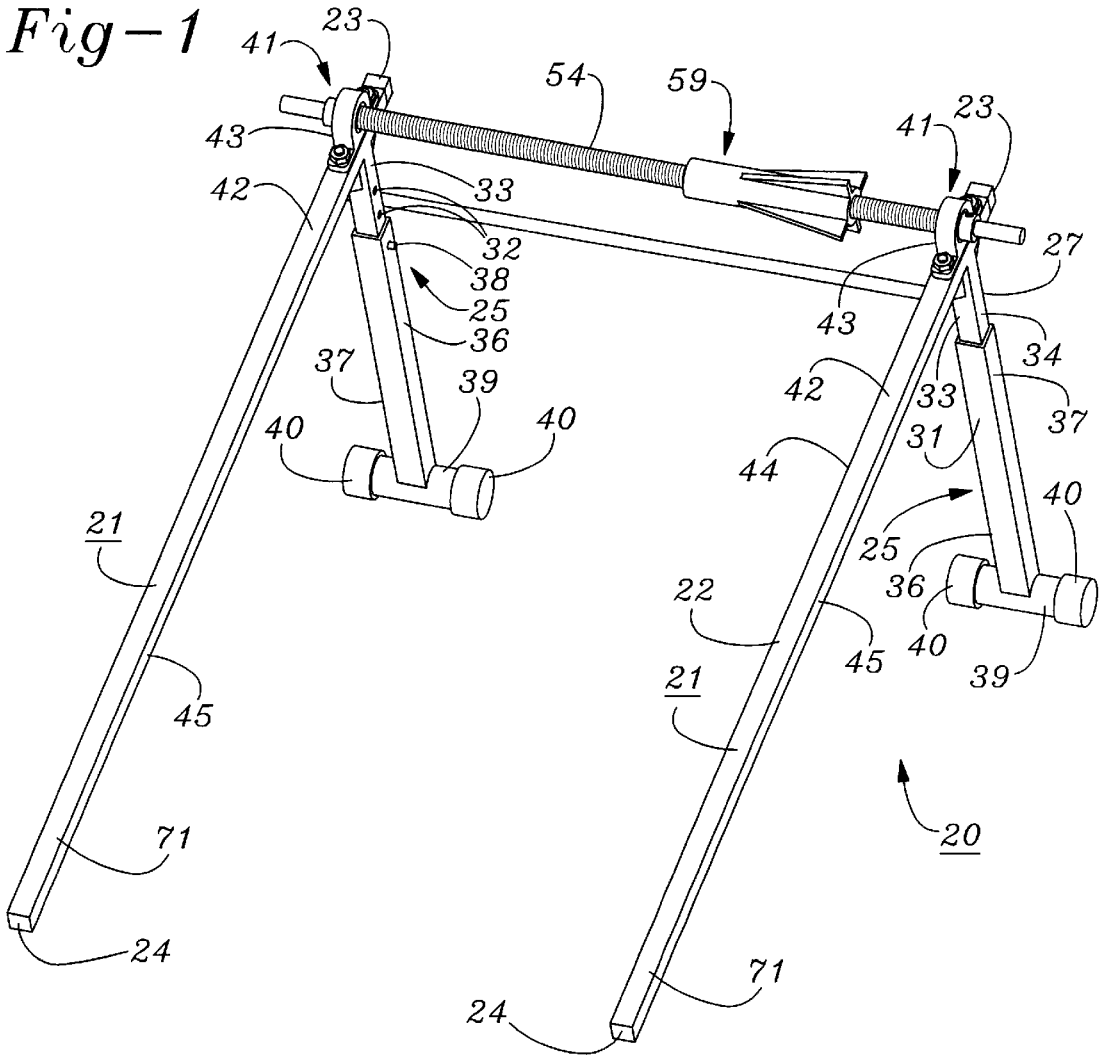
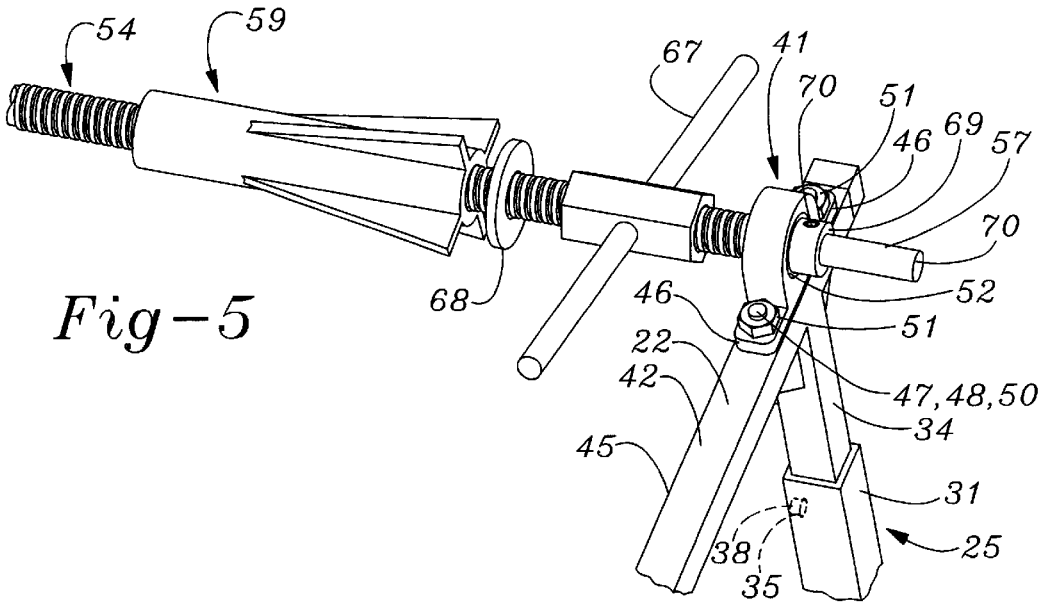
Fig-5

39
25
39
25
A
B
22
22
25
67
54
41
E
F
E
B

CABLE REEL LIFTER/TRANSPORTER

BACKGROUND OF THE INVENTION

A. Field of the Invention

The present invention relates to apparatus and equipment used to manipulate large, heavy reels or spools on which are wound lengths of cable and the like. More particularly, the invention relates to an apparatus which facilitates manual transportation and elevation of heavy cable reels above a support surface to permit free rotation of the reel, thereby permitting cable to be payed out from or wound onto the reel.

B. Description of Background Art

Large diameter electrical cable, wire rope and flexible tubing such as that used to distribute natural gas are usually supplied on large wooden spools or reels. Reels of this type have a cylindrical barrel for winding cable or the like, and a pair of disk-shaped flanges of larger diameter than the barrel at opposite ends of the barrel, for retaining material wound onto the barrel. The combined weight of a reel and the cable, tubing or the like wound onto the reel may exceed several hundred pounds. Accordingly, moving such reels between various locations at a job site can often be a cumbersome and laborious task. Moreover, paying cable or tubing off of a reel, or winding such material back onto a reel, are laborious tasks. One type of prior art device used for handling heavy cable reels includes a pair of laterally opposed parallel rails to receive the circular end plate flanges of the reel. Rollers mounted within the channels rotatably support the rims of the cable reel flanges, allowing the cable to rotate to permit paying out or taking up cable. Such devices provide no means for transporting cable reels.

A variety of other types of devices intended to facilitate the handling of reels or cylindrical objects are disclosed in the following U.S. patents:

Pelletier, U.S. Pat. No. 4,030,679 discloses an identical pair of support stands for lifting a roll of floor covering material from a position on a supporting surface to an elevated position in which the roll is free to rotate, allowing materials to be unrolled. The axle of a carpet roll is supported by upwardly opening yokes, attached to each support stand, which has a short horizontally disposed base leg and a longer vertical standard.

Gebo, U.S. Pat. No. 4,469,289 discloses a reel stand apparatus for rollably supporting a reel or spool of cable, the apparatus consisting of a pair of stanchions each having a base frame including a pair of short perpendicularly disposed horizontal frame members and a vertical post having a rollable reel axle support.

Setzke, U.S. Pat. No. 4,746,078 discloses a reel lifting and support device having a pair of identical units each comprising a lower elongated support arm which is initially disposed in a generally horizontal position, a short arm disposed obliquely upwardly from a distal end of the long arm, and a plurality of sockets disposed perpendicularly to the upper portion of the short arm, for receiving support axles for reels of different heights. Each unit also includes a brace unit or beam member pivotably connected to the short arm between the sockets, the brace unit being disposed obliquely downwards towards the long arm and being pivotably attached thereto. A short hollow cylindrical tube disposed transversely across the junction of the long arm and short arm serves as a fulcrum and pivot axis for the apparatus so that when the long arms are pivoted down from an upwardly angled position to a horizontal position, a reel on an axle supported by the sockets is pivoted upwards to a freely rotatable position above the ground, because short arm and the attached sockets are thereby pivoted to a higher altitude Arrington, U.S. Pat. No. 4,932,601 discloses a reel lift comprising a pair of identical stands, each having a short horizontally disposed angle iron base, a short angle iron upright member depending perpendicularly upwards from the base, a handle rod fastened to and extending parallel upwards from the upright member, and a reel axle support sleeve fastened transversely to one side of the upright member, near its upper end. The front edge of each angle iron base plate serves as a fulcrum or pivot edge when the apparatus with attached cable reel is pivoted from a position in which the handle are angled downwards from an upright vertical position, to a vertical position in which the cable reeling elevated above a support surface to permit its free rotation.

Other U.S. patents related generally to the field of the present invention include:

Brown, Jr., U.S. Pat. No. 4,172,608, Oct. 30, 1979, Knock Down Cable Reel Holder, Woodruff, U.S. Pat. No. 4,447,012, May 8, 1984, Portable Reel Jack Stand, Bills et al., U.S. Pat. No. 4,701,098, Oct. 20, 1987, Cable Wheel Handling And Transporting Trailer, Franks, Jr., U.S. Pat. No. 4,752,047, Jun. 21, 1988, Cable Spool Holder, Mendoza, U.S. Pat. No. 4,901,937, Feb. 20, 1990, Cable Reel Bearer And Dolly, Jääskeläinen et al., U.S. Pat. No. 5,052,877, Oct. 1, 1991, Carriage For The Transportation Of A Cylindrical Object, J ääskeläinen et al., U.S. Pat. No. 5,242,127, Sep. 7, 1993, Reel Lifting Device With Support Arms Mounted For Flexible Movement, Drew et al., U.S. Pat. No. 5,253,972, Oct. 19, 1993, Roll Dolly, Ferrone, U.S. Pat. No. 5,421,691, Jun. 6, 1995, Roll Transfer Device.

The present invention was conceived of to provide a cable reel lifter/transporter which overcomes certain limitations inherent in all prior art devices intended to be used for manipulating cable reels, and to provide an implement of more versatile utility.

OBJECTS OF THE INVENTION

An object of the present invention is to provide an apparatus for lifting and supporting a cable reel above a supporting surface, thereby permitting free rotation of the reel to allow cable to be payed out from or onto the reel, and for facilitating movement of a cable reel to various desired locations at a job site.

Another object of the invention is to provide a cable reel lifter/transporter apparatus which enables a single individual to elevate a heavy cable reel to a freely rotatable position, with the apparatus disposed in a first orientation, and which enables a single individual to transport the cable reel, with the apparatus disposed in a second orientation.

Another object of the invention is to provide a cable reel lifter/transporter which may readily be attached to and removed from a cable reel.

Another object of the invention is to provide a cable reel lifter transporter which may be readily knocked down, stored and transported by a single individual.

Another object of the invention is to provide a cable reel lifter/transporter which may accommodate cable reels having a wide range of widths as well as diameters.

Various other objects and advantages of the present invention, and its most novel features, will become apparent to those skilled in the art by perusing the accompanying specifications, drawing and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a manually operable apparatus which allows a single person to manipulate heavy reels containing cable, tubing, or the like. The apparatus according to the present invention provides means for elevating a heavy cable reel above a surface to permit free rotation of the reel, thereby allowing cable or tubing to be payed off or onto the reel. The apparatus also provides means enabling a single individual to manually transport heavy cable reels at a job site or similar location.

A cable reel lifter/transporter according to the present invention includes a pair of L-shaped planar frames each having a relatively long straight arm or handlebar and a relatively short leg which depends perpendicularly downwards from a distal or front end of the arm. Each leg is preferably terminated at the lower end thereof by a short tubular foot disposed perpendicularly to the plane of the frame member, the foot protruding equal distances laterally outwards and inwards of the outer and inner side walls of the leg. Each frame member is provided with a bearing protruding upwards from the upper surface of the long frame member arm, in vertical alignment with the downwardly depending leg.

The cable reel lifter/transporter according to the present invention includes an elongated straight reel support shaft, which has a long central portion that is externally threaded and short unthreaded opposite end portions of reduced diameter that are rotatably supported by the bearings on the frame members. The apparatus also includes a pair of arbors having a cruciform cross section and a frusto-pyramidal outer surface adapted to be insertably received in opposite ends of various sized spindle holes of cable reel end flanges. The arbors are slidably mounted on the threaded reel support shaft, and each of the two arbors forcibly inserted into a separate spindle hole in each of two disk-shaped end plates of a cable reel. The two arbors are secured to the cable reel by a pair of opposed cross bar nuts threadingly advanced inwards on the reel support shaft. After the threaded reel support shaft has been secured to a cable reel, the bores of the bearings on opposed L-shaped members are slipped over opposite unthreaded end portions of the reel support shaft, and the shaft is secured to the frame members by a collar fastened to the smaller diameter shaft end protruding outwardly through each bearing.

To elevate a cable reel attached to the apparatus according to the present invention, the frame members are rotated around the axis of the reel support shaft until the tubular fee contact the ground. Then, downward pressure is exerted on the rear or proximal ends of the elongated arms of the L-shaped frame members, causing the short legs at the distal or front ends of the members to pivot around the tubular axes of the feet, thereby raising the upper ends of the legs, and the attached bearing and reel support shaft, to a higher elevation. At this height, the flange ends of the cable reel are elevated above the ground, allowing free rotation of the reel. To use the apparatus to transport a cable reel, the frame arms are rotated in an opposite direction, lifting the tubular feet to a position above the ground. With the frame members thus disposed, the outer ends of the arms may be grasped to push the reel rollably along the surface in the manner of a wheelbarrow, the two longitudinally spaced apart circular end plates of the cable reel serving as wheels.

BRIEF DESCRIPTION OF THE DRAWINGS

FIG. 1 is a perspective view of a cable reel lifter/transporter apparatus according to the present invention.

FIG. 5 is a fragmentary upper right perspective view of the apparatus of FIG. 1, showing an arbor and cross bar nut thereof installed.

DESCRIPTION OF THE PREFERRED EMBODIMENTS

Figure 2:
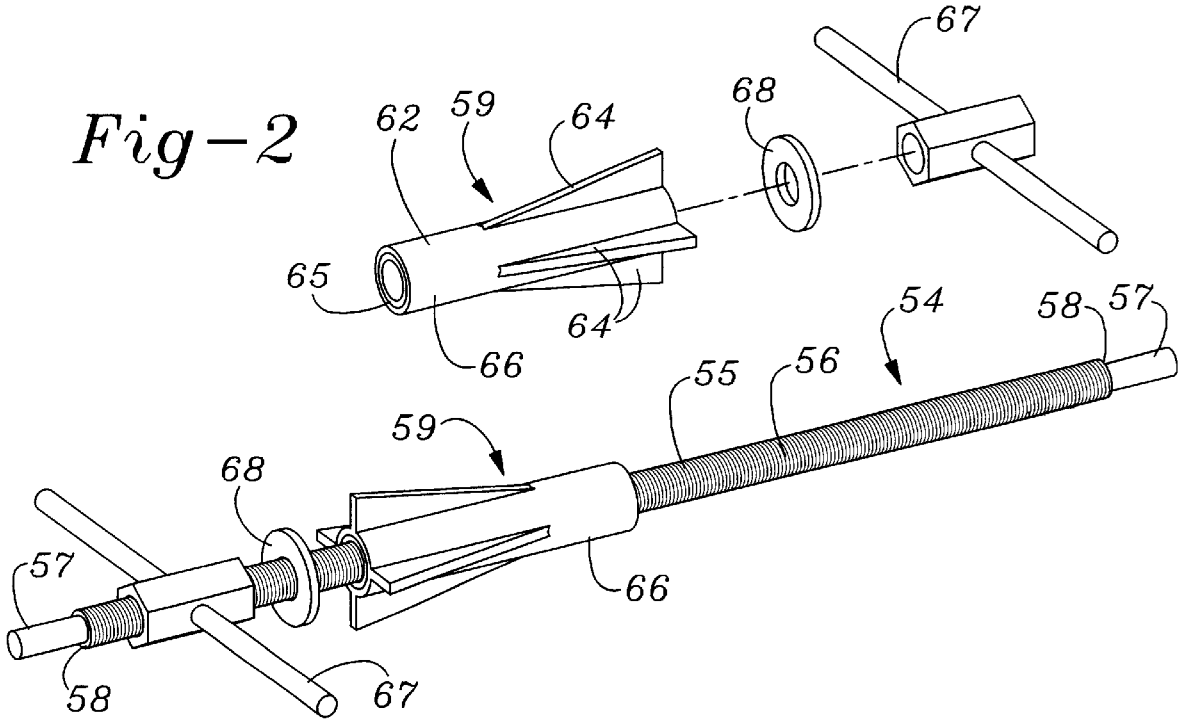
FIG. 2 is a partly fragmentary exploded upper perspective view of the apparatus of FIG. 1.

FIGS. 1–9 illustrate a basic embodiment of a cable reel lifter/transporter according to the present invention.

Referring first to FIG. 1, a cable reel lifter/transporter 20 according to the present invention may be seen to include a pair of parallel laterally opposed, L-shaped planar frames 21. Each frame 21 includes a relatively long straight beam member 22 comprising an arm or handlebar having a front distal transverse end 23 and a rear transverse end 24. Handlebar 22 is made of strong, rigid material such as square steel tubing having an I.D. of ¾" and an O.D. of 1".

Figure 4:
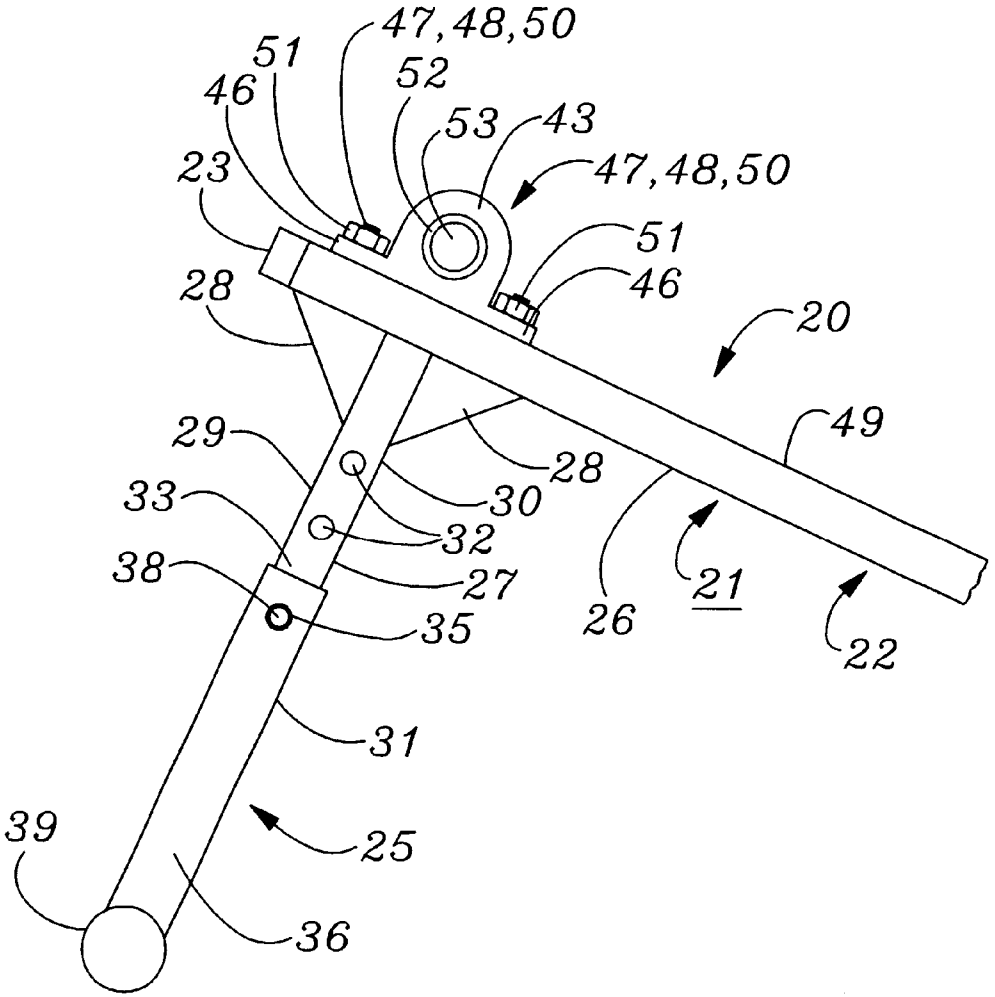
FIG. 4 is a fragmentary inner side elevation view of the apparatus of FIG. 1.

As may be seen best by referring to FIG. 4, each frame 21 has a relatively short straight leg 25 which depends perpendicularly downwards from lower longitudinal wall surface 26 of handlebar 22, near the front or distal end of the handlebar. As shown in FIG. 4, leg 25 preferably is of a telescopic construction permitting adjustment of its length. Thus, as shown in FIG. 4, leg 25 consists of an upper, inner tubular section 27 which is welded to lower wall surface 26 of handlebar 22, a short distance inward from front transverse end 23 of the handlebar. Desirably, two triangularly shaped gusset plates 28 are positioned between and welded to bottom wall surface 26 of handlebar 22, and front and rear wall surfaces 29 and 30, respectively, of upper leg section 27.

As may be seen best by referring to FIG. 1 in conjunction with FIG. 4, telescoping leg 25 includes an outer, lower tubular section 31 which longitudinally slidably receives upper leg section 27. As shown in FIG. 4, a plurality of longitudinally spaced apart holes 32 are provided through inner and outer side walls 33 and 34 of upper leg section 27. As is also shown in FIG. 4, a pair of transversely aligned holes 35 is also provided through inner and outer wall surfaces 36 and 37 of lower, outer tubular leg section 31. A pin 38 inserted through holes 35 in outer, lower leg section 31 and a selected pair of holes 32 through upper, inner leg section 25 secures the lower leg section to the upper leg section at a desired extension length.

As may be seen best by referring to FIG. 1, the lower end of each lower, outer telescopic leg section 31 is terminated at the lower transverse end thereof by a transversely disposed pivot cylinder or foot 39. Foot 39 is preferably of tubular construction and preferably extends laterally outwards equal distances from inner and outer side walls 36 and 37 of lower leg sections 31. Preferably, the opposite transverse ends of each foot 39 are each capped with a protective polymer end cup 40.

Referring now to FIG. 4 in addition to FIG. 1, cable reel lifter/transporter 20 may be seen to include a pair of bearing assemblies 41, one each of which protrudes upwards from upper wall surface 42 of each handlebar 22, in approximate vertical alignment with leg 25 protruding downwards from lower surface 26 of the handlebar. Bearing assembly 41 includes a housing 43 of generally uniform thickness and having parallel side walls generally aligned with inner and outer side walls 44 and 45 of handlebar 22. Housing 43 is generally disk-shaped, modified by lower longitudinally outwardly protruding mounting lugs 46, which are used to secure the bearing housing to handlebar 22 by means of bolts 47 passing through holes 48 in upper wall 49 of handlebar 22, and through vertically aligned holes 50 through the mounting lugs, the bolts being capped by nuts 51.

As may be seen best by referring to FIGS. 1 and 4, each bearing assembly 41 includes a central annular sleeve 52 rotatably supported within bearing housing 43 by ball bearings, rollers or other friction reducing elements, not shown. Sleeve 52 has through its thickness dimension a transversely disposed circular bore 53. Bearing assemblies 41 on frame 21 are used to rotatably support a cable reel support shaft 54, as will now be described.

Referring now to FIGS. 1, 2, 3 and 5, cable reel lifter/transporter 20 may be seen in include a cable reel support shaft 54. As may be seen best by referring to FIG. 2, cable reel support shaft is of elongated cylindrical shape and has a relatively long central portion 55 provided with external helically disposed threads 56. Cable reel support shaft 54 also has at each longitudinal end thereof a relatively short, reduced diameter outer end portion 57, joined to threaded central portion 55 by a transversely disposed annular shoulder flange 58. Although the exact dimensions of cable reel support shaft 54 are not critical, in an example embodiment, the cable support shaft was fabricated from a steel cylinder having a diameter of about 1 inch, an overall length of about 3 feet, a central threaded portion having a length of 2 feet, 4 inches, and reduced diameter end portions 57 each having a length of about 4 inches and a diameter of ⅝ inch.

Cable reel lifter/transporter 20 includes components which function cooperatively with cable reel support shaft 54 to rotatably support a cable reel, as will now be described.

Figure 3:
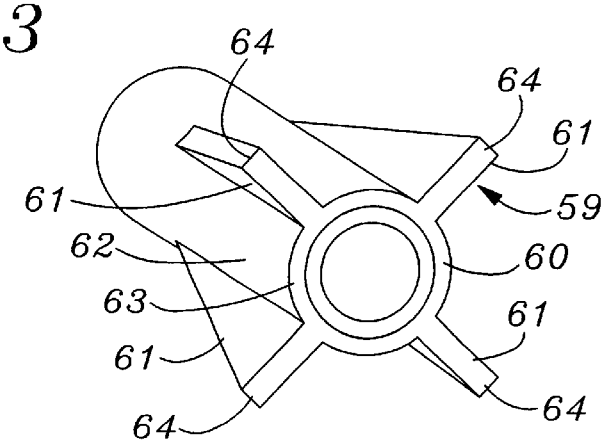
FIG. 3 is a perspective view of an arbor and cross bar nut comprising part of the apparatus of FIG. 2, on a somewhat enlarged scale.
Figure 6:
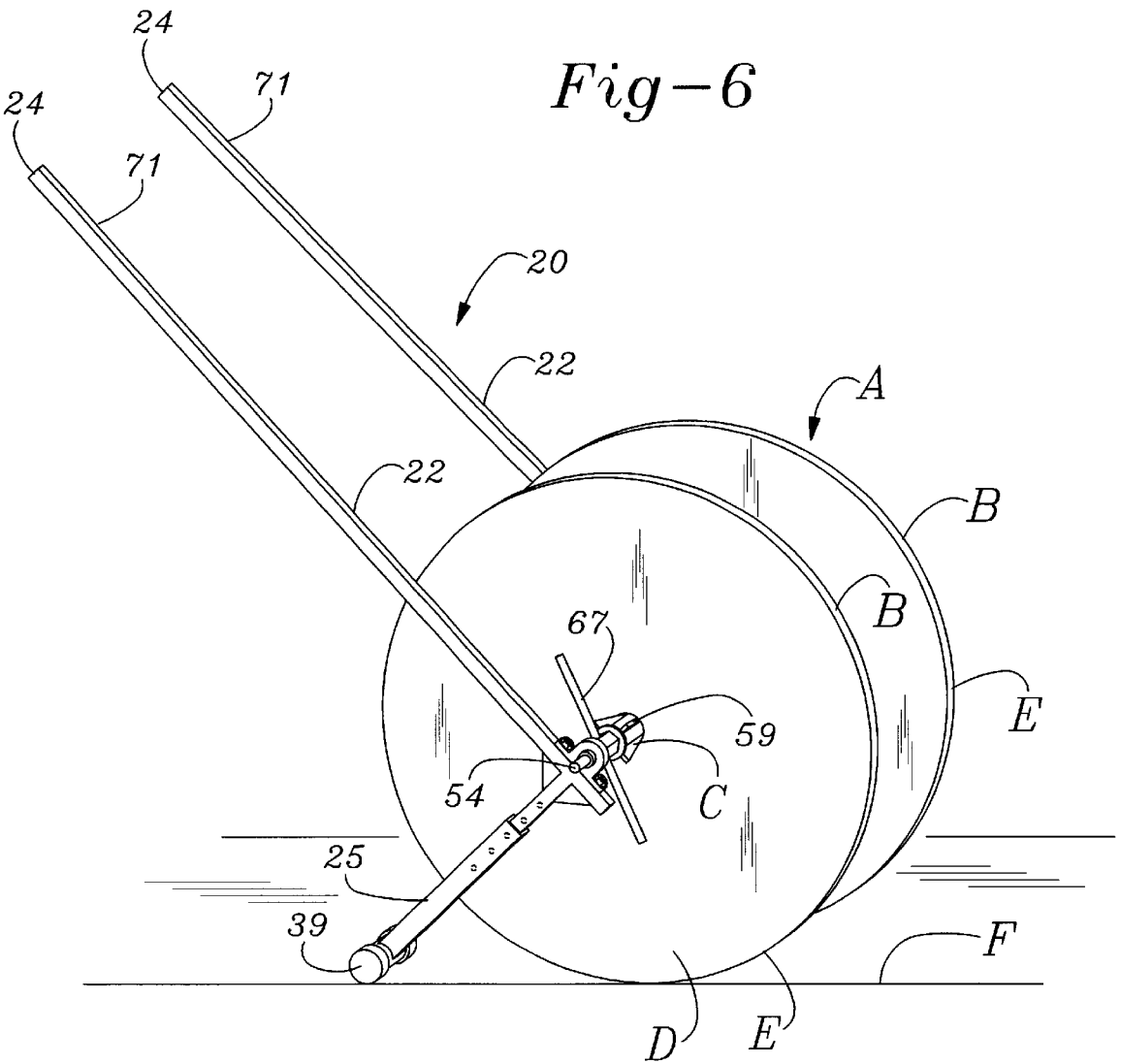
FIG. 6 is a right side perspective view of the apparatus of FIG. 1, showing the apparatus installed on a cable reel.

Referring now to FIGS. 2 and 3, cable reel lifter/transporter 20 may be seen to include a pair of tapered arbors 59 that slide coaxially over cable reel support shaft 54. As shown in FIG. 6, arbors 59 are inserted and tightened into spindle holes C through the disk-shaped end flanges or plates B of a cable reel A, in a manner which will be described below in more detail.

As shown in FIGS. 2 and 3, each arbor 59 has a central hollow tubular portion 60, and four triangularly-shaped fins 61 which protrude radially outwards from the outer wall surface of the central tubular portion. As may be seen best by referring to FIG. 3, fins 61 have a cruciform configuration, and extend longitudinally forward along the outer cylindrical wall surface 62 of central tubular portion 60 of the arbor, from the rear transverse end wall 63 thereof.

As may be seen best by referring to FIGS. 2 and 3, the outer longitudinal edge walls 64 of fins 61 taper radially inwardly and intersect outer cylindrical wall surface 62 of central tubular portion 60 of the arbor rearward from the front transverse edge wall 65 of the central tubular end portion. With this construction, arbor 59 has a rear longitudinal portion provided with cruciform fins having a frusto-pyramidal outer envelope protruding radially outwards from a central tubular portion 60, and a front longitudinal portion 66 having a cylindrical shape. Front cylindrical end portion 66 of arbor 59 has an outer diameter slightly smaller than the smallest diameter reel spindle hole that apparatus 20 is intended to be used with. For larger diameter reel spindle holes, tapered outer longitudinal end walls 64 of fins 61 abut the spindle hole bore when tubular portion 66 of arbor 59 is inserted sufficiently far into the bore. The manner of attaching cable reel support shaft 54 and arbors 59 to a cable reel may be best understood by referring to FIG. 6 in conjunction with FIGS. 2 and 3.

As shown in FIGS. 2 and 5, cable reel lifter/transporter 20 includes a pair of cross bar or capstan nuts 67 which are threaded onto opposite ends of cable reel support shaft 54, after an arbor 59 and washer 68 are slid onto one end of the reel support shaft. The opposite end of reel support shaft 54 is then inserted into spindle hole bore C of a cable reel A, protruding outwards from opposite end plate B of the cable reel, whereupon a washer 68 and capstan nut 67 are threaded onto that end of the reel support shaft. Opposing cross bar nuts 67 are then tightened down to secure arbors 59 within spindle holes C of cable reel A, thus securing said cable reel support shaft in a fixed longitudinal position within the spindle holes. After cable reel support shaft 54 has been thus secured to a cable reel 54, frames 21 are attached to the cable reel shaft, in the following manner.

Referring now to FIG. 5, the reduced diameter ends 57 of cable reel support shaft 45 are shown to be insertably received in sleeves 52 of bearing assemblies 41 of frame members 22, which have been positioned adjacent opposite ends of the reel support shaft after the latter has been secured to a cable reel (not shown) in the manner described above. Sleeve 52 of bearing assembly 41 is slid onto cable reel support shaft 54 sufficiently far for the inner annular face of the sleeve to abut shoulder flange 58 of the shaft. A collar 69 is then slipped over cable reel shaft end 57, and secured to the shaft by means of set screws 70 disposed radially through the collar. By this means, a pair of frame members 22 is secured to cable reel support shaft 54 on opposite sides of cable reel A, as shown in FIG. 6.

The manner in which cable reel lifter/transporter 20 may be utilized to lift and transport a cable reel may be best understood by referring to FIGS. 6–9 in conjunction with the following description.

Figure 7:
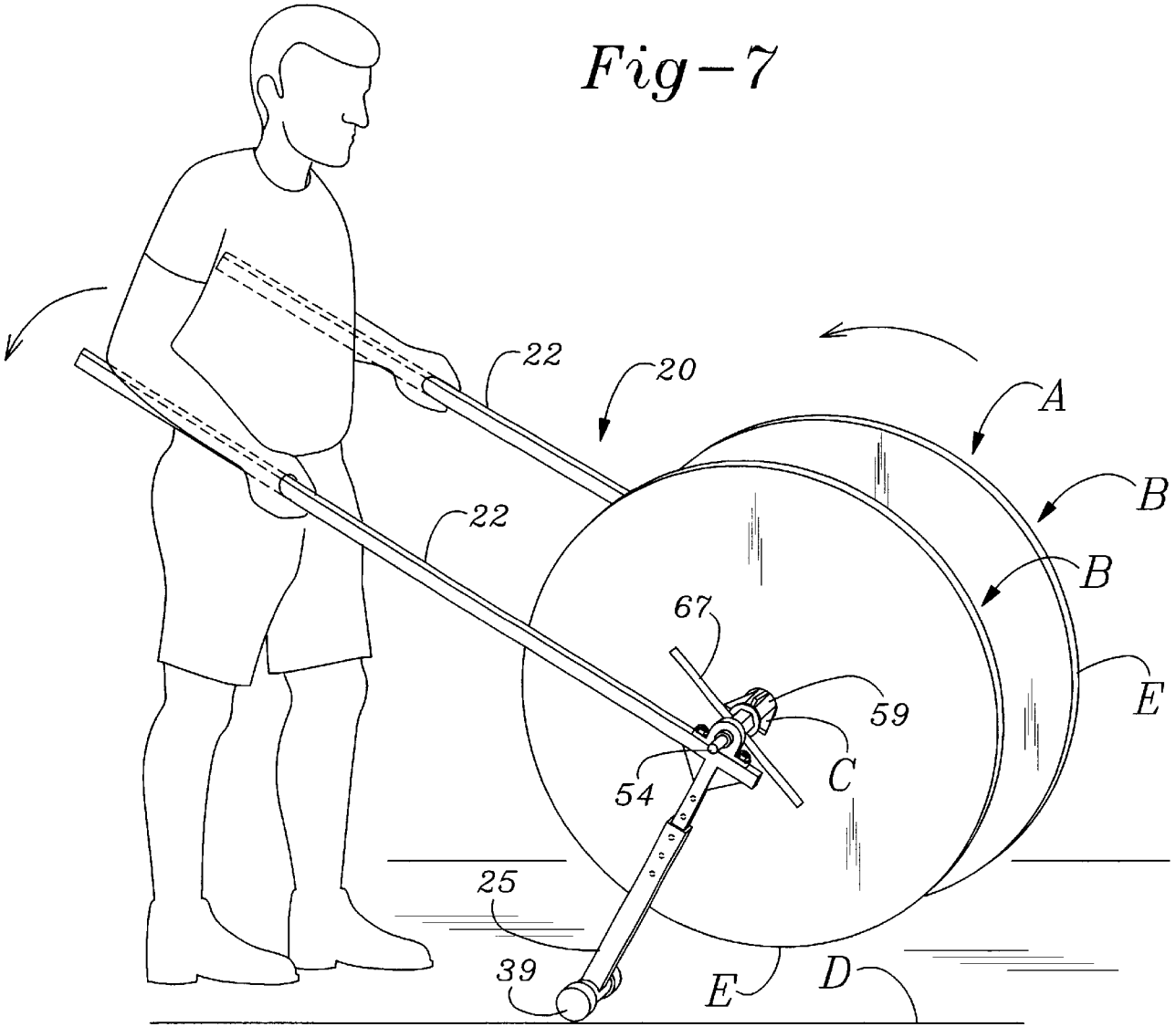
FIG. 7 is a view similar to that of FIG. 6, but showing the apparatus in the process of elevating the cable reel to a freely rotatable position.
Figure 8:
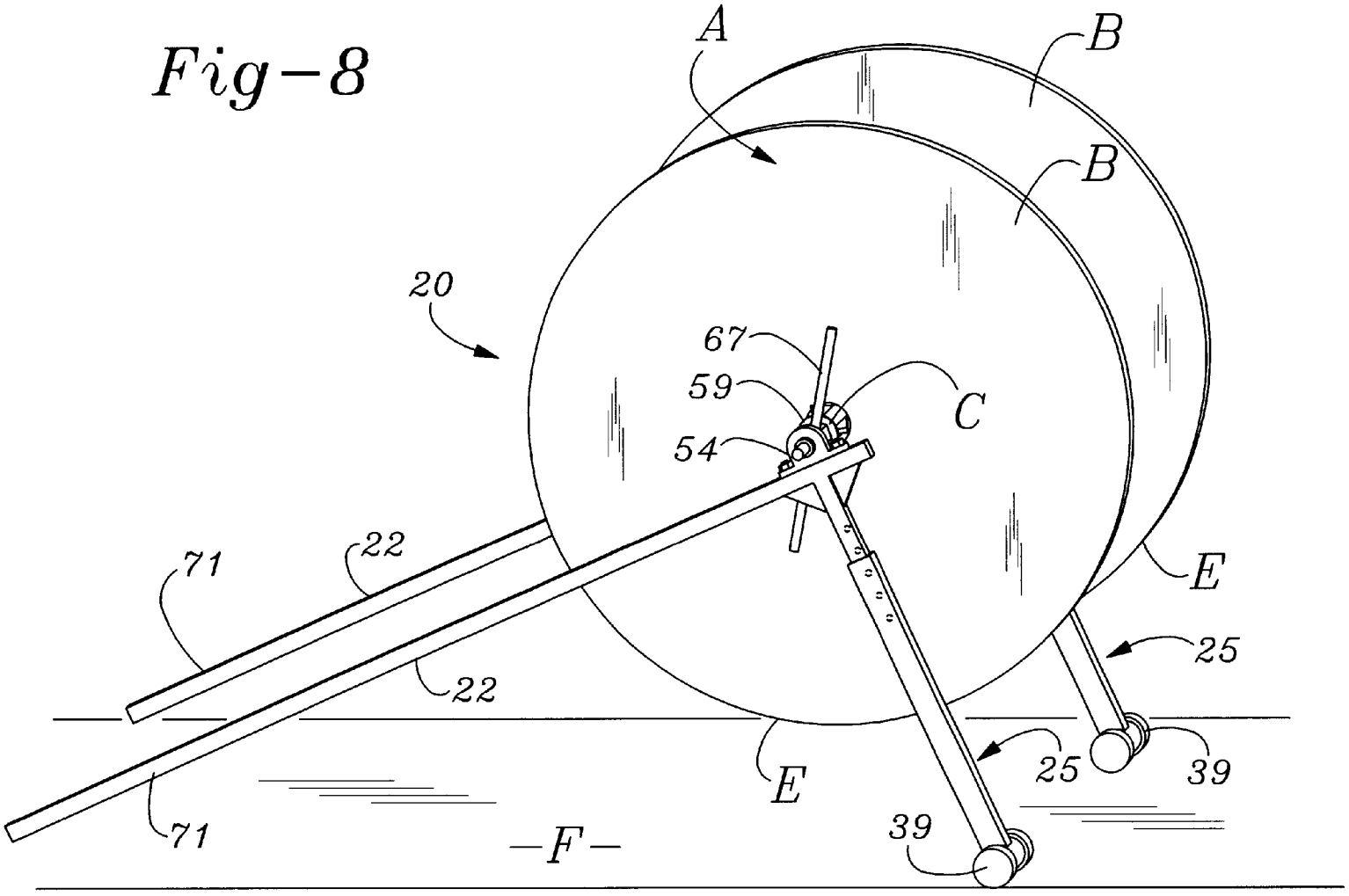
FIG. 8 is a view similar to that of FIG. 7, but showing the apparatus in a stable equilibrium position in which the cable reel is freely rotatable.

As shown in FIG. 6, cable reel lifter/transporter 20 has been attached to a cable reel A with rims E of cable reel end flanges B supported by a ground surface F. Then, as shown in FIG. 7, rear end portions 71 of handlebars 22 are grasped and pushed downwards. This action causes cable reel lifter/transporter apparatus 20 to pivot counterclockwise about the common transversely disposed longitudinal axes of pivot cylinder/feet 39, raising cable reel rims E above ground surface F. Ends 71 of handlebars 22 are brought down into contact with ground support surface F, thus supporting cable reel A in an equilibrium position with rims E above the ground surface, as shown in FIG. 8.

Figure 9:
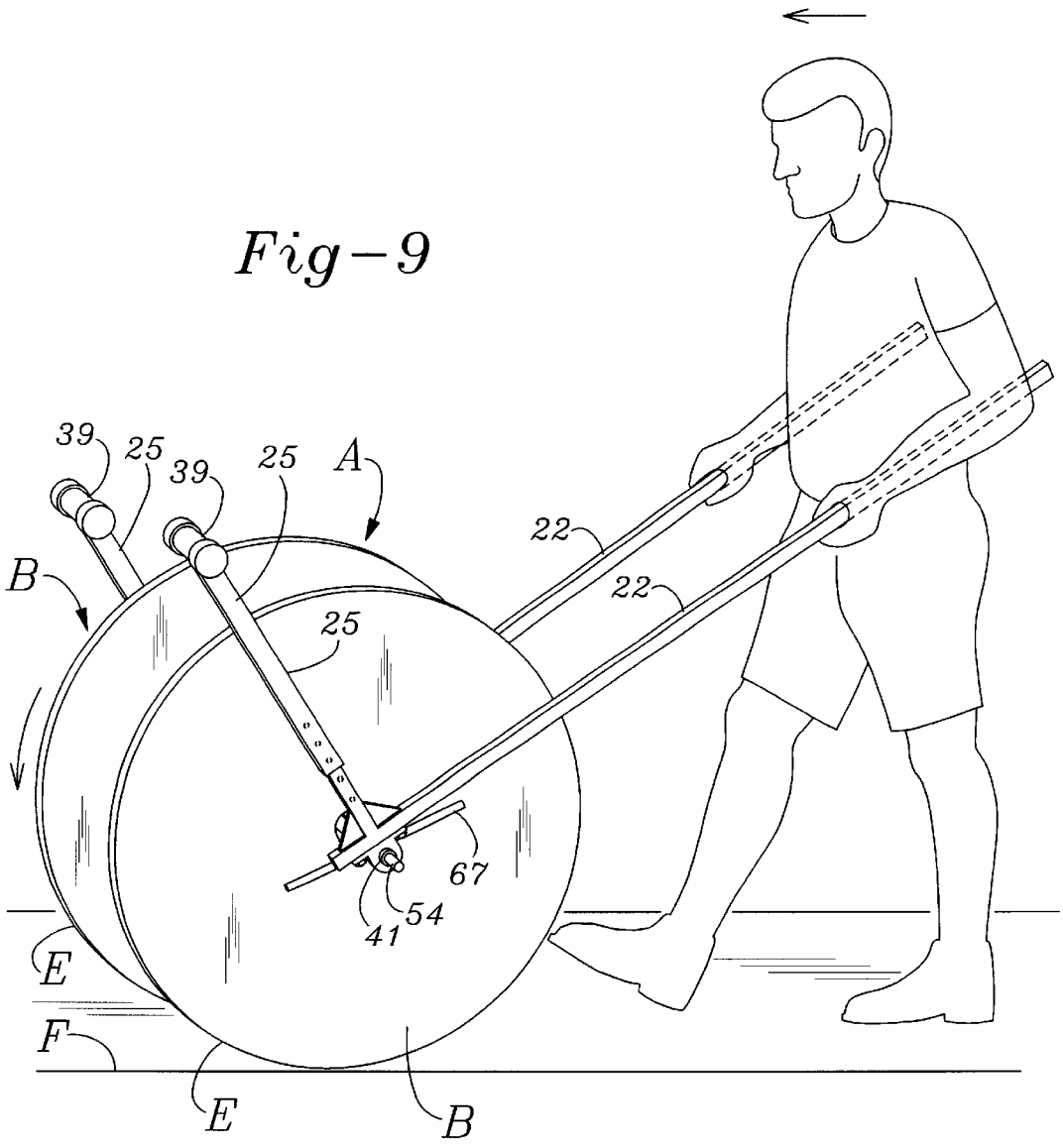
FIG. 9 is a right side perspective view showing arms or handle bars thereof rotated to a position clockwise from that shown in FIG. 6, thereby allowing the handle bars to be used to roll the reel to a desired location.

The manner of using cable reel lifter/transporter 20 to transport cable reels may be best understood by referring to FIGS. 6 and 9. As shown in FIG. 9, handlebars 22 of apparatus 20 are rotated in a clockwise sense from the position shown in FIG. 6. With the handlebars thus positioned, feet 39 of apparatus 20 are elevated above ground surface F. Thus positioned, handlebars 22 may be grasped and pushed forward, or to the left in FIG. 9, thereby causing reel A to roll counterclockwise on rims E of the cable reel, in the manner of a wheel barrow.

FIGS. 10–19 illustrate a modification 80 of cable reel lifter/transporter 20 shown in FIGS. 1–9 and described above.

Referring first to FIGS. 10–12, 17 and 18, it may be seen that modified cable reel lifter/transporter 80 includes a pair of L-shaped frames 81, each of which has a long handlebar 82 and a short perpendicularly disposed leg 85 which are welded to adjacent vertices 106 and 107 of a. bearing housing 103 consisting of a short length of square cross section tubing. Cable reel lifter/transporter 80 includes a bearing journal assembly 101 comprising a collar 112 welded to an upper vertex 108 of bearing housing 103, located above lower vertex 107 welded to leg 85.

Figure 12:
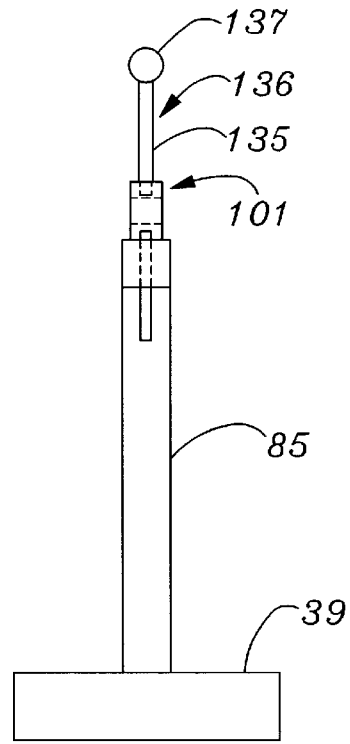
FIG. 12 is an end elevation view of the article of FIG. 10.
Figure 11:
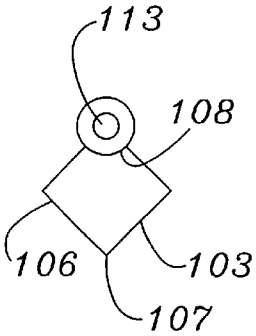
FIG. 11 is a fragmentary view of the article of FIG. 10.
Figure 10:
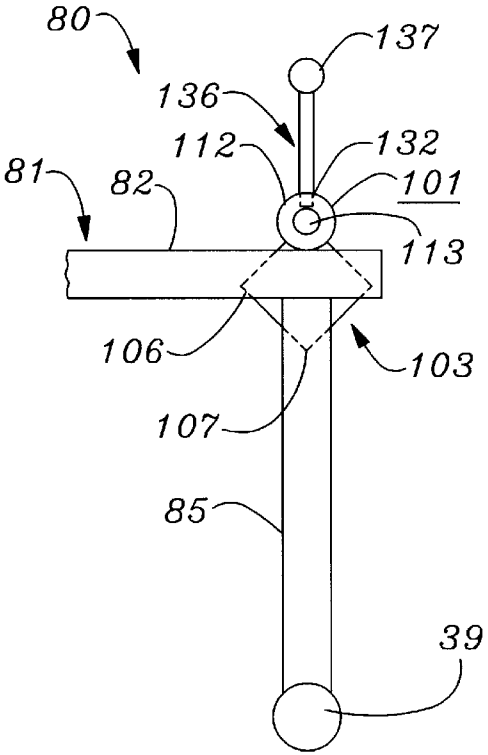
FIG. 10 is a side elevation view of a modified side frame comprising part of a modification of the apparatus shown in FIGS. 1–9.

As shown in FIGS. 10 and 12, collar 112 has through its thickness dimension a transversely disposed circular bore 113. As will be described in detail below, bore 113 of each collar 112 is provided to receive an opposite longitudinal end of a modified cable reel support shaft 114 which is also described below.

Figure 13:
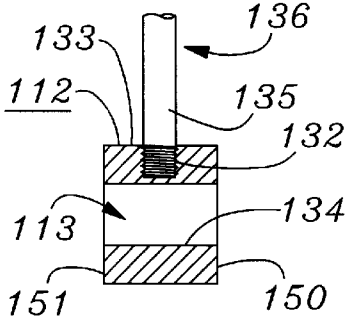
FIG. 13 is a fragmentary longitudinal sectional view of the structure of FIG. 11, on an enlarged scale.
Figure 14:
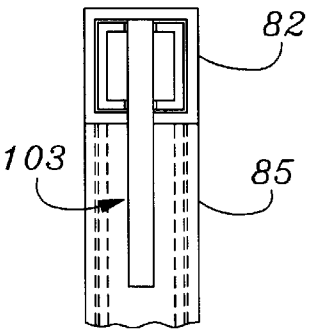
FIG. 14 is a fragmentary end elevation view of the structure of FIG. 11, on an enlarged scale.

Referring to FIGS. 13 and 14 in addition to FIGS. 10 and 12, it may be seen that collar 112 includes a threaded, vertically disposed bore 132 which extends vertically downwardly from outer circumferential wall surface 133 of the collar through inner circumferential wall surface 134 of the collar, thus communicating with transverse bore 113 of the collar. Threaded bore 132 is provided to threadingly receive the threaded lower shaft 135 of a fastening rod 136 having at the upper end thereof a hand grip ball 137.

Figure 15:
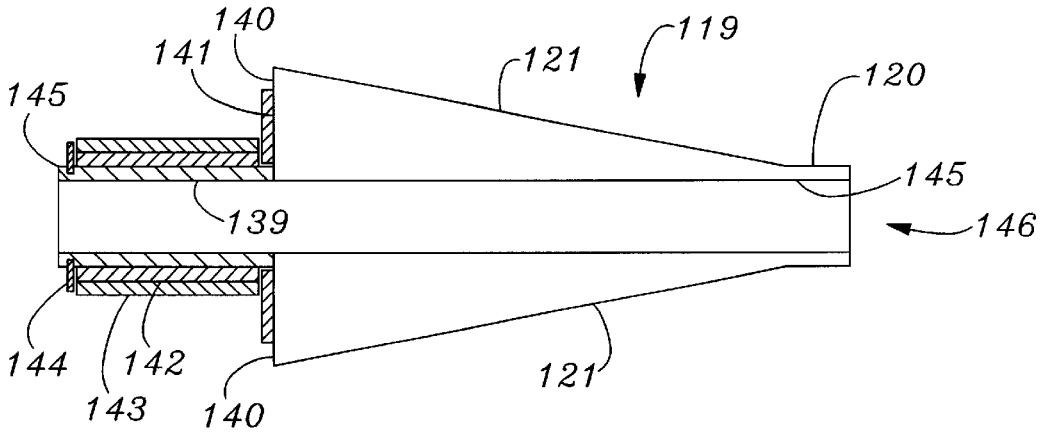
FIG. 15 is a side elevation view of a modified arbor for the apparatus of FIG. 10.

FIG. 15 illustrates an arbor 119 which comprises part of modified cable reel lifter/transporter 80. As shown in FIG. 15, arbor 119 has four longitudinally, tapered, triangularly-shaped fins 121 which are arrayed in a cruciform transverse cross sectional disposition, similar to fins 61 of the basic embodiment of arbor 59 shown in FIG. 3 and discussed above. However, central tubular portion 120 of arbor 119 includes a rear tubular extension 139 which protrudes longitudinally rearwardly beyond the rear transverse edge walls 140 of fins 121 rather than being coplanar with the edge walls as in arbor 59. A washer 141 fits coaxially over rear tubular arbor extension 139, and is preferably welded to outer transverse walls 140 of fins 121.

Referring still to FIG. 15, it may be seen that arbor 119 includes a bronze bearing bushing 142 which fits coaxially and rotatably over tubular arbor extension 139. Bearing bushing 142 is secured longitudinally in position on tubular arbor extension 139 by a sleeve 143 which fits coaxially over the bushing, the sleeve being secured to the outer transverse end wall 145 of the extension by a cup-shaped flange 144 secured to the extension by a C-clip.

Figure 16:
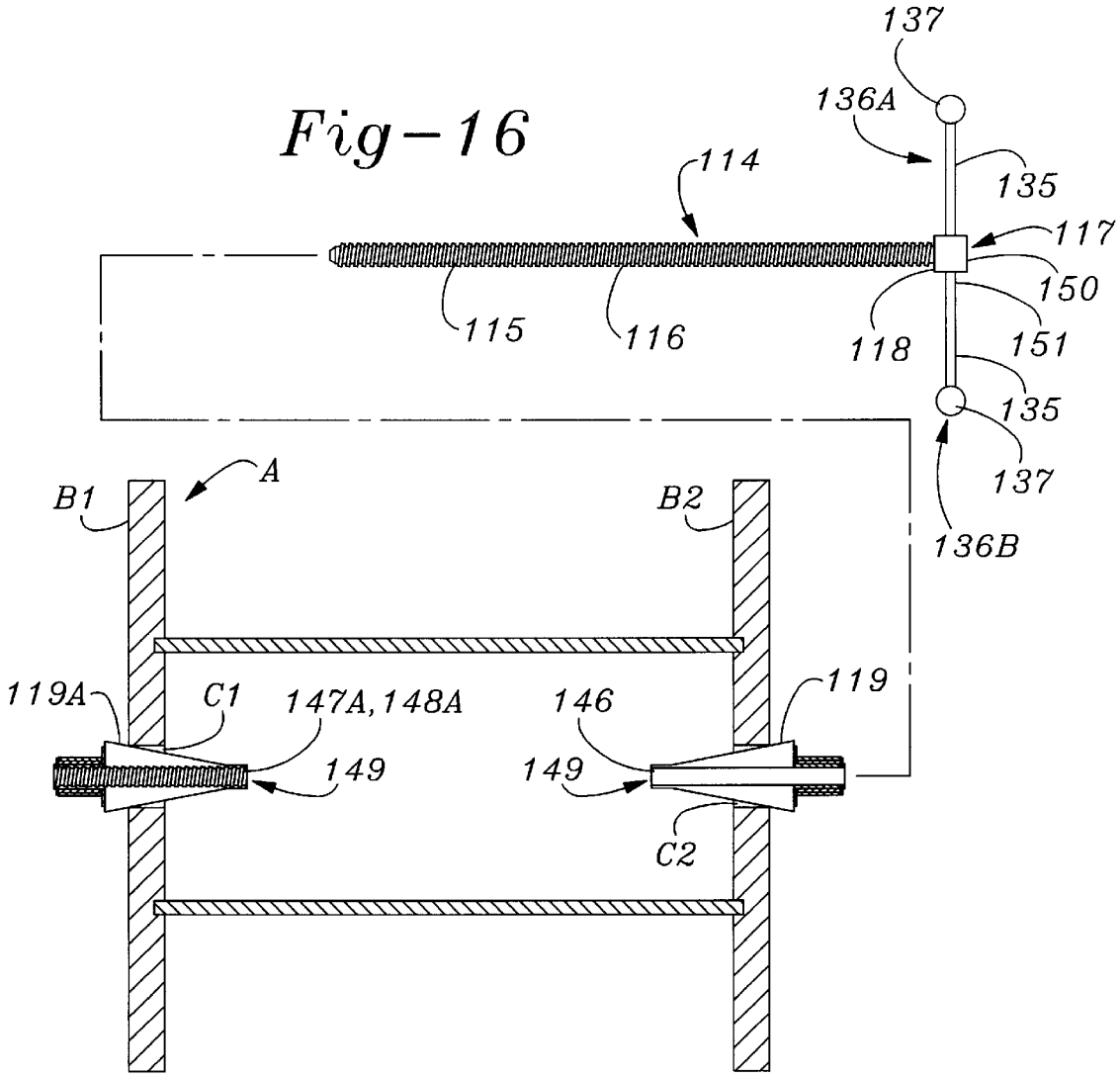
FIG. 16 is a fragmentary upper plan view showing components of a modified cable reel lifter/transporter and the manner of attaching the modified apparatus of FIG. 11 to a cable reel.

Referring now to FIG. 16 in conjunction with FIG. 15, it may be seen that modified cable reel lifter/transporter 80 includes a first arbor 119 in which the central tubular portion 120 thereof has a smooth inner cylindrical wall surface 145 defining therewithin a smooth bore 146. As shown in FIG. 16, cable reel lifter/transporter 80 also includes a second arbor 119A substantially similar in construction and function to first arbor 119. However, central tubular portion 120 of arbor 119A has an inner cylindrical wall surface 147 provided with helical threads 148 which define a threaded bore 149 which is disposed longitudinally through the tubular portion of the arbor.

Referring still to FIG. 16, it may be seen that modified cable reel lifter/transporter 80 includes an elongated cable reel support shaft 114 having a relatively long longitudinal portion 115 thereof provided within external helically disposed threads 116. Shaft 114 has at one longitudinal end thereof an enlarged diameter boss 117 having a transversely disposed inner annular shoulder 118. Cable reel support shaft boss 117 has formed inward from the outer longitudinal surface 150 thereof a pair of diametrically opposed, transversely inwardly disposed and aligned, internally threaded bores 151. Each bore 151 is provided to receive threaded lower shaft 135 of a separate one of a pair of fastening rods 136 of the type described above.

Modified cable reel lifter/transporter 80 is used to transport and/or lift a cable reel A in the same manner as the basic embodiment 20 described above. However, modified lifter/transporter 80 is attached to a cable reel A and modified L-shaped frames 81 in a somewhat different manner, as will now be described.

Referring now to FIGS. 5 and 10, threaded end 115 of shaft 114 of cable reel lifter/transporter 80 is first inserted inwardly through bore 113 of a collar 112 surmounting a first side frame 81. The front tubular portion of internally threaded arbor 119A is then inserted into the spindle hole C1 of a circular cable reel end plate B1, located on a side of a cable reel A opposite to that of the first side frame. Next, a smooth-bore arbor 119 is inserted into the spindle hole C2 of circular cable reel end plate B2 located adjacent first side frame 81. Threaded end 115 of shaft 114 is then inserted through smooth bore 146 of arbor 119, through cable reel A, and threaded into threaded bore 149 of arbor 119A. To facilitate threading end 114 of shaft 115 into threaded bore 149 of arbor 119A, one or preferably a pair of fastening rods 136 are first threaded into transverse bores 151 in cable reel support shaft end boss 117, hand grip balls 137 of the fastening rods then being grasped and orbited in the manner of the bars of a capstan.

Figure 17:
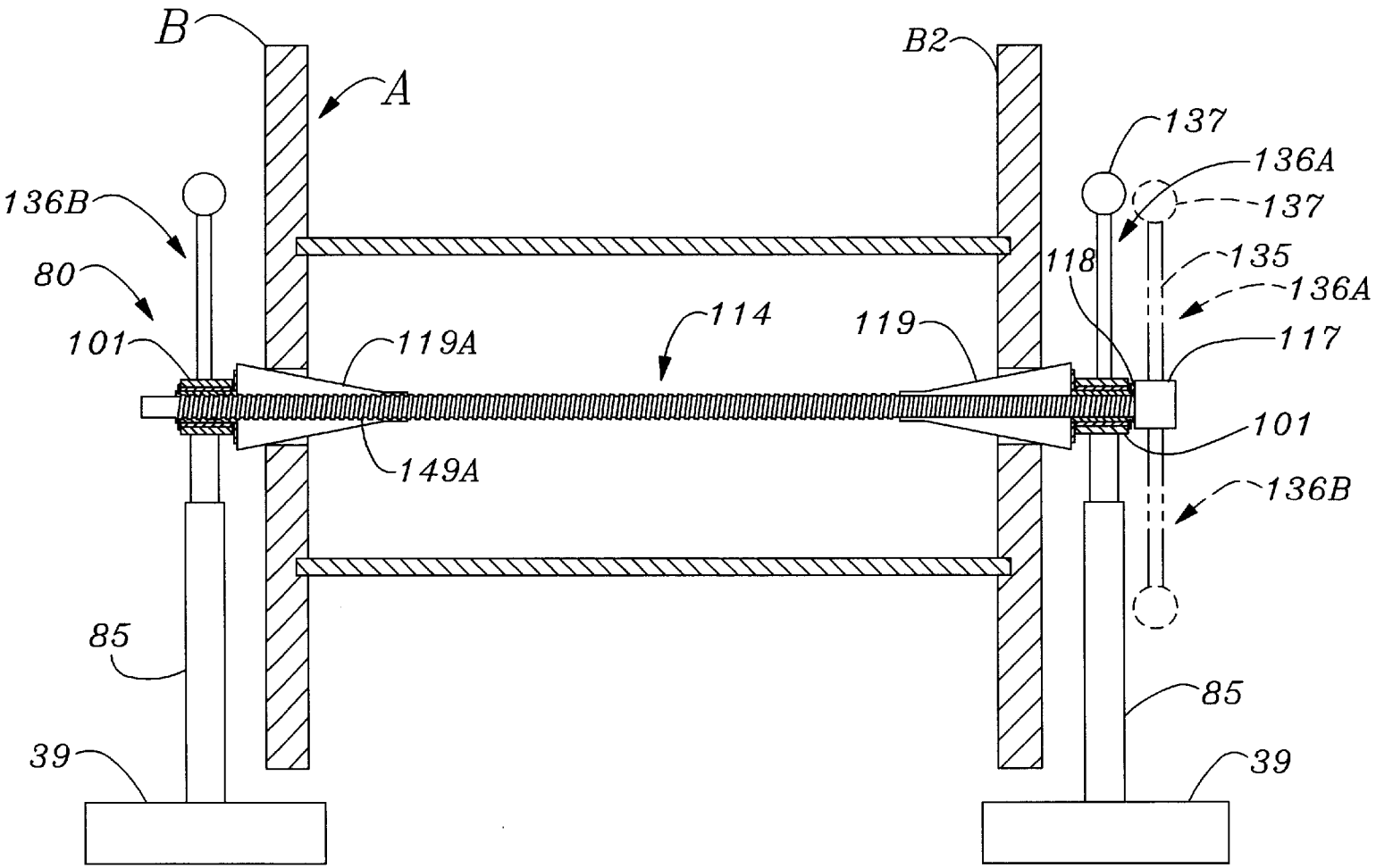
FIG. 17 is a front elevation view showing the modified cable reel lifter/transporter of FIG. 16 attached to a cable reel.

As shown in FIG. 17, cable reel shaft 114 is threadingly tightened in threaded bore 149 of arbor 119A sufficiently for shoulder 118 of shaft end boss 117 to bear against the outer annular wall surface 150 of collar 112 and force inner annular wall surface 151 of the collar against outer annular wall surface 152 of C-cup 144 of near arbor 119, thereby tightening arbor 119 and arbor 119A into cable reel end plate holes C2 and C1, respectively. Threaded end 115 of shaft 114 protruding outwards from arbor 119 may then be inserted outwardly through bore 113 of collar 112 surmounting a second side frame 81 located on a longitudinal side of cable reel A opposite and adjacent to first side frame 81. Fastening rods 136 may then be unscrewed from shaft boss 117, and screwed into threaded bores 132 of opposite side frame collars 112, sufficiently far to tighten against sleeve 143 of arbors 119 and 119A, thereby holding shaft 114 rotatably within the collars.

Figure 19:
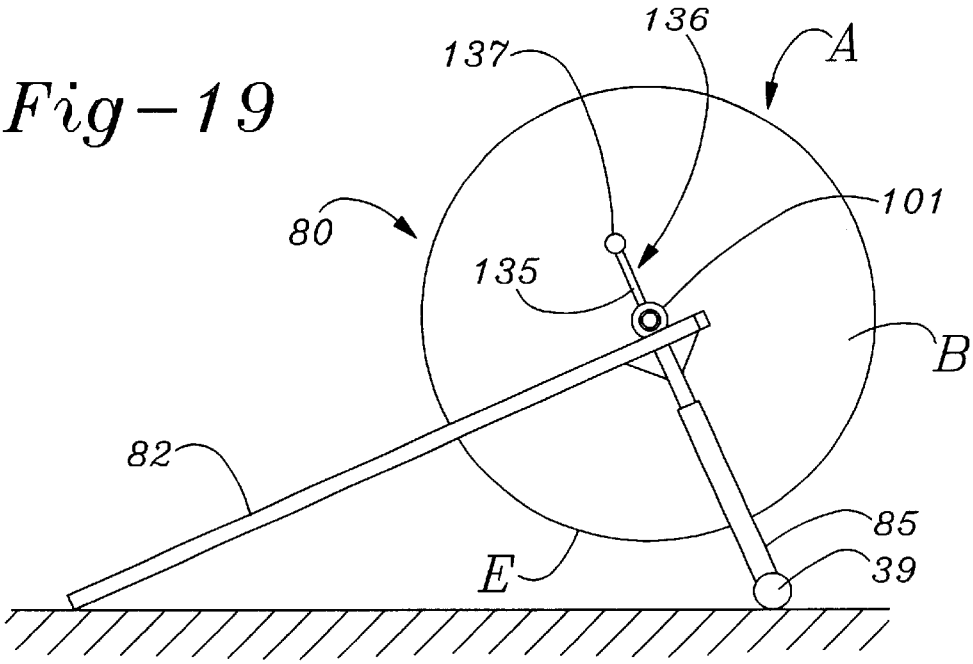
FIG. 19 is a view similar to that of FIG. 18, but showing the apparatus thereof in a stable equilibrium position in which the cable reel is freely rotatable.
Figure 18:
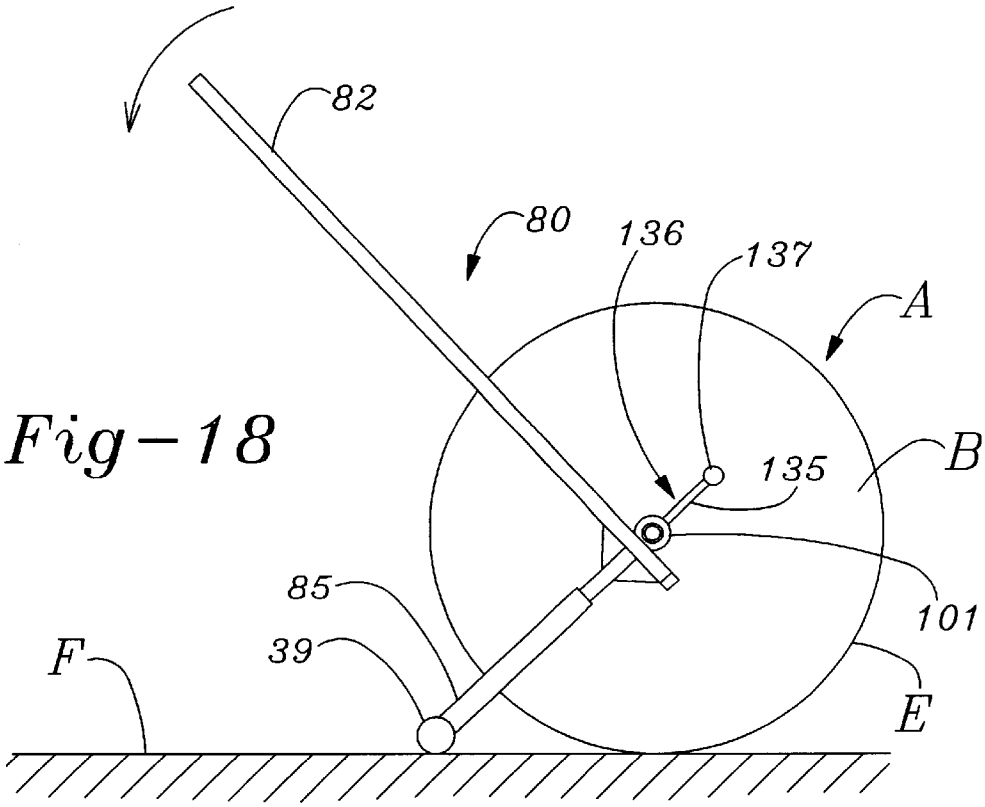
FIG. 18 is a side elevation view showing the apparatus of FIG. 17 preparatory to pivoting the cable reel thereof to a freely rotatable position.

FIGS. 18 and 19 are views showing modified cable reel lifter/transporter 80 in use, corresponding to FIGS. 6 and 8 showing the basic embodiment of the apparatus in use, and described above.

Figure 20:
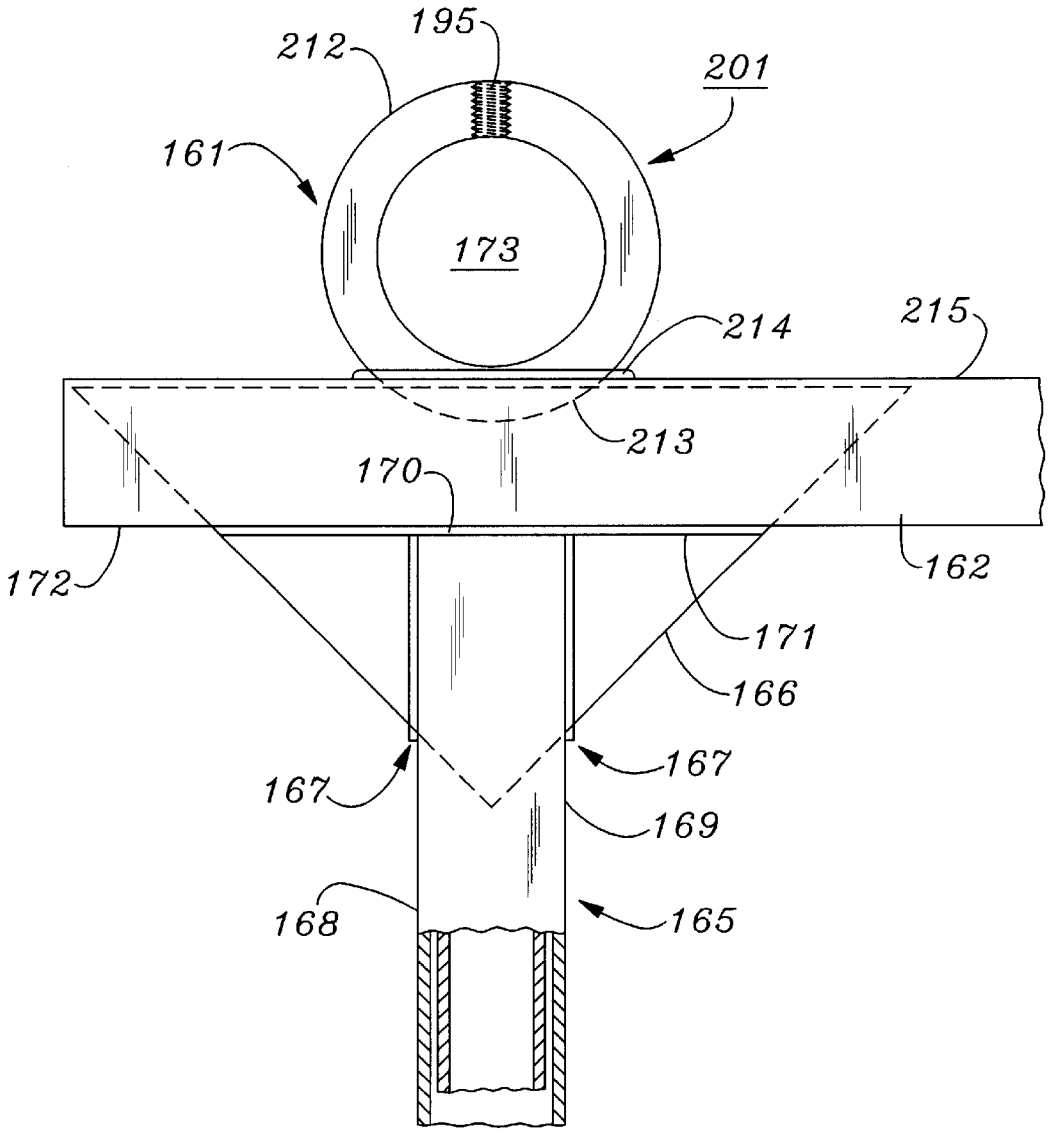
FIG. 20 is a side elevation view of a modification of the side frame of FIG. 10.

FIG. 20 illustrates a modification of the modified cable reel lifter/transporter 80 shown in FIGS. 10–18 and described above.

As shown in FIG. 20, modified cable reel lifter/transporter 160 includes a pair of L-shaped frames 161, each of which has a long handlebar 162 and a short leg 165 which depends perpendicularly downwards from a front end of the handlebar. Handlebar 162 and leg 165 are made of lengths of steel tubing which are secured together by welds to a triangular-shaped gusset plate 166 Gusset plate 166 is received in a pair of slots 167 located in front and rear walls 168 and 169 of leg 165 and disposed vertically downwards from upper transverse end wall 170 of the leg. Gusset plate 166 is also received in a longitudinally disposed slot 171 located in the lower wall 172 of handlebar 162.

Referring still to FIG. 20, it may be seen that modified cable reel lifter/transporter 160 includes a bearing journal assembly 201 comprising a collar 212, a lower circumferential portion 213 of which protrudes a slight distance perpendicularly downwardly into a longitudinally disposed rectangular aperture 214 provided in the upper wall 215 of handlebar 162, to which the collar is welded.

What is claimed is:

1. An apparatus for manipulating reels of the type used to contain cable and flexible tubing and having an elongated central cylindrical barrel and a pair of longitudinally opposed parallel circular end plates disposed transversely at opposite longitudinal ends of said barrel, each of said end plates having therethrough a central coaxial spindle hole, said apparatus comprising;

a. first and second L-shaped uni-planar side frames disposed in adjustably spaced apart, parallel vertical planes, each of said side frames including a longitudinally elongated handlebar having a rear longitudinal hand grip portion and a relatively shorter leg which depends downwardly from a first, lower side of said handlebar proximate a distal or front end portion of said handlebar, b. first and second tubular bearing supports protruding upwardly from a second, upper side of each of said first and second handlebars, respectively, in axial alignment with a said shorter leg, c. an elongated cable reel support shaft rotatably supportable at opposite longitudinal ends thereof in said first and second tubular bearing supports, d. means for securing said cable reel support shaft in a fixed longitudinal position within said spindle holes, and e. means for securing said opposite longitudinal ends of said cable reel support shaft in a fixed longitudinal position within said tubular bearing supports of said side frames, whereby contacting the lower ends of said legs against a supporting surface and applying downwardly directed force on said rear hand grip portions of said handlebars causes said legs, tubular bearing supports, and attached cable reel shaft to pivot upwardly about said lower ends of said legs, thereby raising said cable reel end plates above said supporting surface sufficiently to permit free rotation of said cable reel.

2. The apparatus of claim 1 further including first and second foot means terminating said lower ends of said first and second legs, respectively, said foot means being adapted to facilitate pivotable motion in a vertical plane of said foot means and legs in contact with said support surface.

3. The apparatus of claim 2 wherein each of said first and second pivot means is further defined as being a tubular member attached to said lower end of each leg, disposed transversely to said leg and the plane of said frame.

4. The apparatus of claim 1 wherein said means for securing said reel support shaft in a fixed position within said spindle holes is further defined as comprising in combination first and second arbors adapted to be inserted inwardly into first and second spindle holes of said cable reel, and means for securing said arbors in a fixed relative longitudinal position on said cable reel support shaft.

5. The apparatus of claim 4 wherein said means for securing said arbors in a fixed relative longitudinal position on said cable reel shaft is further defined as comprising in combination longitudinally disposed, external helical threads on said shaft and first and second nuts threadingly engageable with said shaft and tightenable to exert longitudinally inwardly directed forces on said arbors.

6. The apparatus of claim 1 wherein said means for securing said opposite longitudinal ends of said cable reel support shaft in a fixed longitudinal position within said tubular bearing supports is further defined as comprising in combination a reduced diameter end portion of said shaft insertable into an aperture through said tubular bearing support, a shoulder flange on said shaft of larger diameter than said aperture through said tubular bearing support, and collar means of larger diameter than said aperture through said tubular bearing support fastenable to said reduced diameter end portion of said cable reel shaft protruding outwardly through said tubular bearing support.

7. The apparatus of claim 1 wherein said handlebar portion and said leg portion of each of said frames are joined at an angle of about ninety degrees.

8. The apparatus of claim 1 wherein each of said first and second legs is further defined as being of telescopically adjustable construction, whereby the lengths of said legs may be adjusted.

9. An apparatus for manipulating reels of the type used to contain cable and flexible tubing and having an elongated cylindrical barrel and a pair of longitudinally opposed parallel circular end plates disposed transversely at opposite longitudinal ends of said barrel, each of said end plates having therethrough a central coaxial spindle hole, said apparatus comprising;

a. first and second L-shaped uni-planar side frames disposed in adjustably spaced apart, parallel vertical planes, each of said frames having a longitudinally elongated handlebar having a rear longitudinal portion adapted to be grasped by a hand, and a relatively shorter leg which depends downwardly from a first, lower side of said handlebar proximate a front transverse end wall of said handlebar, b. first and second tubular bearing supports protruding upwardly from an upper longitudinal surface of said front portion of said handlebar in vertical alignment with said leg, said tubular bearing support having through its thickness dimension an aperture disposed transversely to said handlebar and said leg, c. an elongated cable reel shaft having at opposite longitudinal ends thereof means for rotatably supporting said cable reel shaft within said first and second tubular bearing supports with said first and second frames lying in a parallel, side-by-side disposition in horizontally spaced apart, first and second vertical planes, respectively, d. means for securing said cable reel support shaft in a fixed longitudinal position within said spindle holes, and e. means for securing said cable reel support shaft ends in a fixed longitudinal position within said first and second tubular bearing supports.

10. The apparatus of claim 9 wherein said means for securing said cable reel support shaft in a fixed longitudinal position within said cable reel spindle holes is further defined as comprising in combination first and second arbors each having a longitudinally disposed bore for receiving said cable reel support shaft, said arbors being adapted to be inwardly insertably received into said first and second spindle holes of said cable reel, and means for securing said arbors in a fixed relative longitudinal position on said cable reel support shaft.

11. The apparatus of claim 10 wherein said first and second arbors are each defined as including a central elongated tubular portion having an outer diameter smaller than the smallest diameter spindle hole that said apparatus is intended to be used with, and a spindle hole-embracing portion coaxially disposed over said central tubular section, said spindle hole-embracing section longitudinally tapering from a rear transverse cross sectional diameter larger than the largest diameter cable reel spindle hole that said apparatus is intended to be used with, to a front transverse cross section coextensive with said central tubular section of said arbor.

12. The apparatus of claim 11 wherein said spindle hole-embracing section of said arbor is further defined as comprising a plurality of triangularly-shaped fins which protrude radially outwardly from circumferentially spaced apart locations of said central tubular section of said arbor.

13. The apparatus of claim 11 wherein said means for securing said arbors in a fixed relative position on said cable reel support shaft is further defined as comprising in combination longitudinally disposed, external helical threads on said shaft, and first and second nuts threadable over said shaft and tightenable longitudinally inwardly on a rear transverse wall member of said arbor.

14. The apparatus of claim 11 wherein said means for securing said opposite longitudinal ends of said cable reel support shaft in a fixed longitudinal position within said tubular bearing supports is further defined as comprising in combination a reduced diameter end portion at each longitudinal end of said shaft insertable into an aperture through said tubular bearing support, a shoulder flange on said shaft end of larger diameter than said aperture through said tubular bearing support, and collar means of larger diameter than said aperture through said tubular bearing support fastenable to said reduced diameter end portion of said cable reel shaft protruding through said tubular bearing support.

15. The apparatus of claim 11 wherein said central tubular portion of each of said first and second arbors is further defined as having a rear tubular portion which protrudes rearwardly from a rear transverse plane defining a rear transverse surface of said spindle hole-embracing section, said rear tubular portion of said arbor being adapted to be rotatably received in said tubular bearing support.

16. The apparatus of claim 11 wherein said first and second arbors are each further defined as having fitted over said rear tubular portion thereof a cylindrically-shaped bearing bushing.

17. The apparatus of claim 16 wherein said first and second arbors are further defined as comprising a pair in which the central tubular portion of a first one of said arbors has a smooth bore adapted to slidably receive said cable reel support shaft, and the central tubular portion of a second one said arbors has a threaded bore adapted to threadingly receive said cable reel support shaft.

18. The apparatus of claim 17 wherein said means for securing said arbors in a fixed relative longitudinal position on said cable reel support shaft is further defined as comprising a boss of larger diameter than said shaft located at a second, rear end thereof, whereby said threaded-bore arbor may be inserted into the spindle hole of a first, distal cable reel end plate, a second, smooth-bore arbor inserted into the spindle hold of a second, proximal cable reel end plate, said first longitudinal end of said cable reel support shaft inserted inwardly through said smooth bore of said smooth-bore arbor longitudinally through said cable reel and into threading engagement of said threaded bore of said distal threaded-bore arbor, and rotating said boss of said shaft to tighten said boss against said outer transverse wall of said proximal smooth-bore arbor.

19. The apparatus of claim 18 wherein said boss is further defined as being provided with at least one transversely disposed bore adapted to receive a cross bar to facilitate tightening said shaft within said threaded arbor bore.

20. The apparatus of claim 18 wherein said means for securing said cable reel support shaft ends in a fixed longitudinal position within said first and second tubular bearing supports is further defined as comprising first and second clamp means for securing said first and second shaft ends longitudinally within said first and second tubular bearing supports whereby said first longitudinal end of said cable reel support shaft may be inserted inwardly through said first tubular bearing support, through said smooth bore arbor, through said cable reel and into threading engagement of said threaded bore of said distal arbor and rotating said boss of said shaft to tighten said boss against an outer transverse wall of said tubular bearing support, thereby tightening an inner transverse wall of said tubular bearing support against an outer transverse wall of said proximal arbor.

21. The apparatus of claim 20 wherein each of said first and second tubular bearing supports is further defined as being a collar having therethrough a longitudinally disposed aperture adapted to receive an end of said cable reel support shaft.

22. The apparatus of claim 21 wherein said collar is further defined as having through an outer wall surface thereof a transversely disposed threaded bore which communicates with said longitudinally disposed aperture, said threaded bore being adapted to receive a threaded member tightenable against said shaft end.

* * * * *